United States Patent [19]

Anderson

[11] Patent Number: 4,616,825

[45] Date of Patent: Oct. 14, 1986

[54] AEROBIC EXERCISE MACHINE

[76] Inventor: Melvin J. Anderson, Rte. #1, Box 8800, Inkom, Id. 83245

[21] Appl. No.: 708,019

[22] Filed: Mar. 4, 1985

[51] Int. Cl.[4] ..... A63B 21/06

[52] U.S. Cl. ..... 272/134; 272/72; 272/117

[58] Field of Search ..... 272/117, 118, 134, 136, 272/142, 143, 130, 72, 73, 116

[56] References Cited

U.S. PATENT DOCUMENTS

| | | | |
|---|---|---|---|
| 1,205,426 | 11/1916 | Barnhill | 272/72 |
| 2,145,940 | 2/1939 | Marlowe | 272/173 X |
| 2,825,563 | 3/1958 | Lawton | 272/130 |
| 3,380,737 | 4/1968 | Elia et al. | 272/72 |
| 3,917,262 | 11/1975 | Salkeld | 272/134 X |
| 4,300,760 | 11/1971 | Bobroff | 272/72 X |
| 4,421,307 | 12/1983 | Cunnington et al. | 272/143 X |

FOREIGN PATENT DOCUMENTS

| | | | |
|---|---|---|---|
| 498341 | 5/1930 | Fed. Rep. of Germany | 272/142 |
| 661778 | 6/1938 | Fed. Rep. of Germany | 272/142 |
| 496740 | 2/1937 | United Kingdom | 272/142 |

*Primary Examiner*—Richard J. Apley
*Assistant Examiner*—Robert W. Bahr
*Attorney, Agent, or Firm*—Fisher, Christen & Sabol

[57] ABSTRACT

The invention is an aerobic exercise machine for exercising all major muscles simultaneously. The aerobic exercise machine includes a horizontal frame with an attached seat and two foot pedals. Two handgrips are provided at an upper end of a hand lever. The hand lever is pivotably mounted on the machine to be in front and slightly above an operator's pelvic area. The foot pedals are on the bottom end of a foot lever that is pivotably mounted directly forward of the handgrips. The hand and foot levers are connected by a separate cable to a common junction that connects to a flat belt which travels up through a vertical support over two flat pulleys and then down to a stack of free weights. The hand lever cable has an extra pulley which increases the leverage in order to more nearly match the stronger push of the leg muscles.

6 Claims, 7 Drawing Figures

FIG. 1
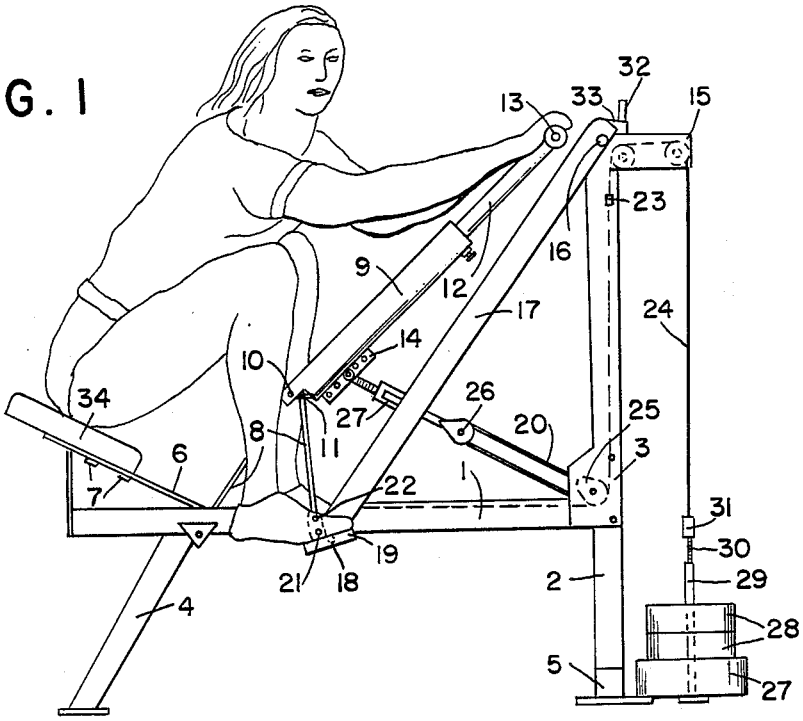
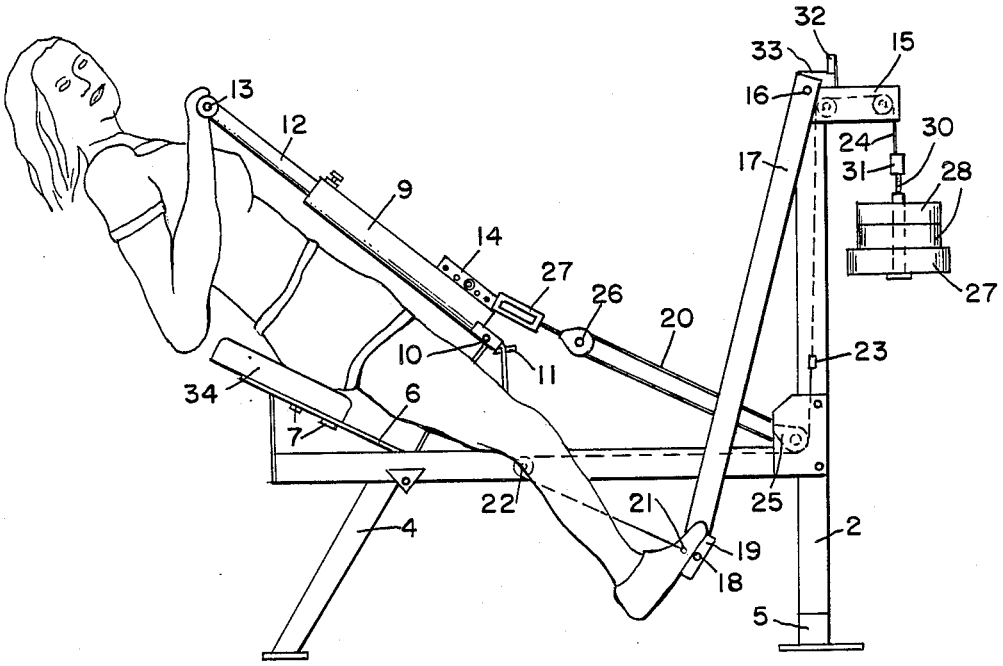
FIG. 2

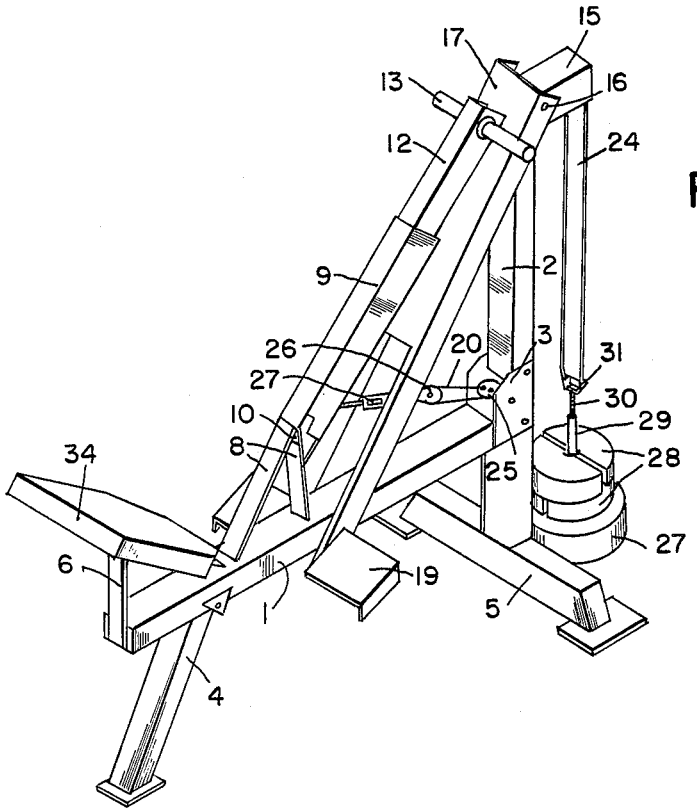
FIG. 3
FIG. 4
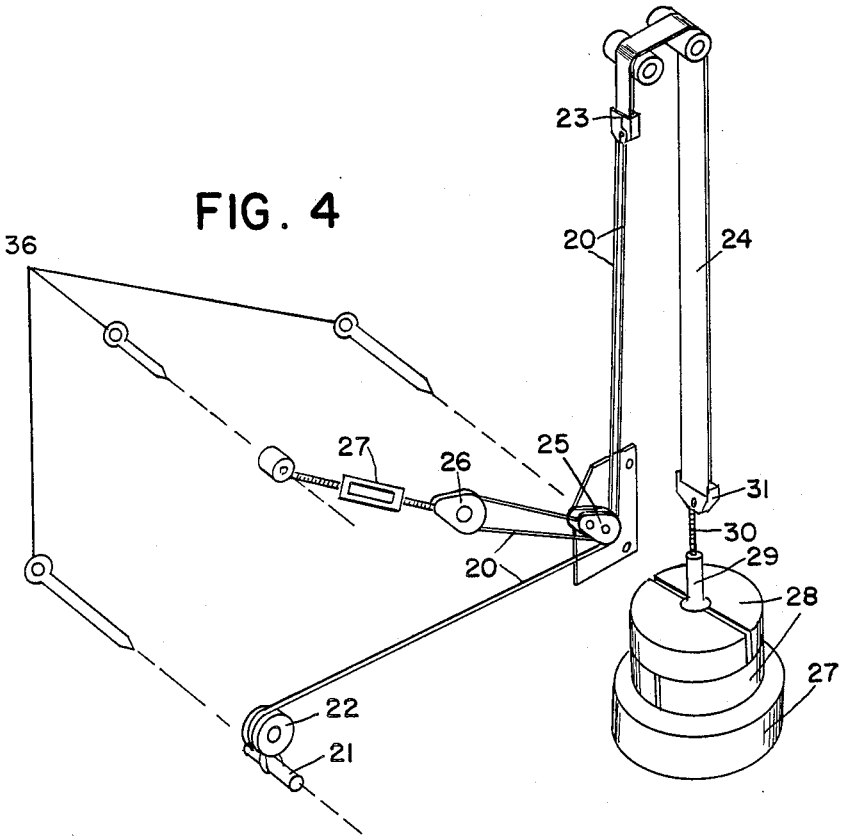
FIG. 7
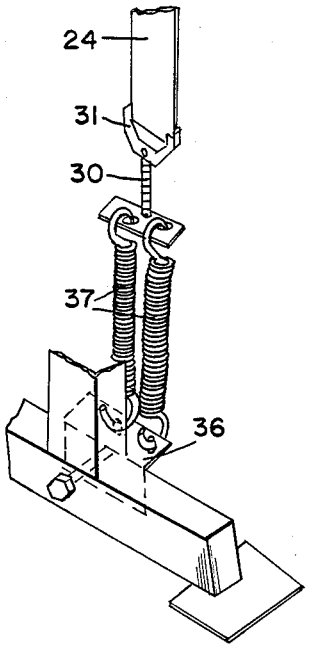

AEROBIC EXERCISE MACHINE

SUMMARY OF THE INVENTION

This exercise machine is designed to strengthen and flex the whole body while simultaneously providing good aerobic stimulation to the operator.

Heretofore the traditional exercise bicycles while providing fair aerobic exercise work only the legs and are unconfortable to operate. Similarly the usual rowing machines with the sliding seat impose most of the effort on to the arms and are thereby poor aerobic machines. Aerobic exercise is obtained when the muscles are worked to the point where they demand large amounts of oxygen which consequently exercises the heart and respiratory system. Hence the most effecient aerobic exercise is accomplished by using the greatest number of large body muscles at their respective optimum capacity. The aerobic exercise machine exercises all the larger muscles simultaneously and is adjustable so as to equalize the effort on each muscle according to its size and strength. This is not accomplished by existing machines. Also most existing machines do not allow the extreme flexing movements need to maintain good body flexibility.

The foremost object of this invention is to provide an exercise machine that will work all the major muscles of the body, according to their relative strength, simultaneously thereby allowing the busy person to maintain a consistant daily fitness program.

Secondly, the extra pulley and several connecting points on the hand lever make it possible to match the effort on the arms and upper torso with that on the stronger leg muscles. This prevents undue tiring of some muscles and allows a more consistant and effecient exercise program.

Thirdly, working all the larger muscles such as the legs, arms shoulder, back, stomach and even hand muscles creates a greater demand for oxygen thru the cardiovascular and respiratory system thereby making the machine an excellent aerobic device equivalent to that of joging but without the ill effects of road jar, auto fumes and inclement weather.

A further object is to provide an excercise machine that is comfortable to operate. Unlike the exercise bicycle with its austere seat the operator of this machine sits on a flat well padded seat and being in a stationary position can comfortably exercise for a considerable time each day.

Another object of this invention is to provide exercise that takes the body through the extreme movements from a tightly crouched position to a completely laid out and extended position affording the aspect of flexibility and suppleness to the joints.

In addition this invention allows a complete adjustment to fit all sizes of people and gradations of strength and fitness. The machine has four major adjustments i.e. the split half weights making for easy load changes, an extendable arm lever for tall people and those with extra long arms, a variable positioned seat and a changeable hookup on the arm lever allowing a variation of the effort on the arms and upper body.

Finally this invention can be easily folded to facilitate moving or storage and is of simple but rugged design.

Further objects and advantages of my invention will become apparent from a consideration of the drawings and ensuing description thereof.

BRIEF DESCRIPTION OF THE DRAWING

FIG. 1 is a side view of the machine with the operator in the closed position.

FIG. 2 is the same side view but with the operator in the extended or laid out position.

FIG. 3 is an oblique view of the machine.

FIG. 4 is an oblique view of the belt, cable, pulley and weight system.

FIG. 7 is a section detail where the free weights are alternatively replaced with a system of springs.

DESCRIPTION OF THE PREFERRED EMBODIMENT

Figure 5:
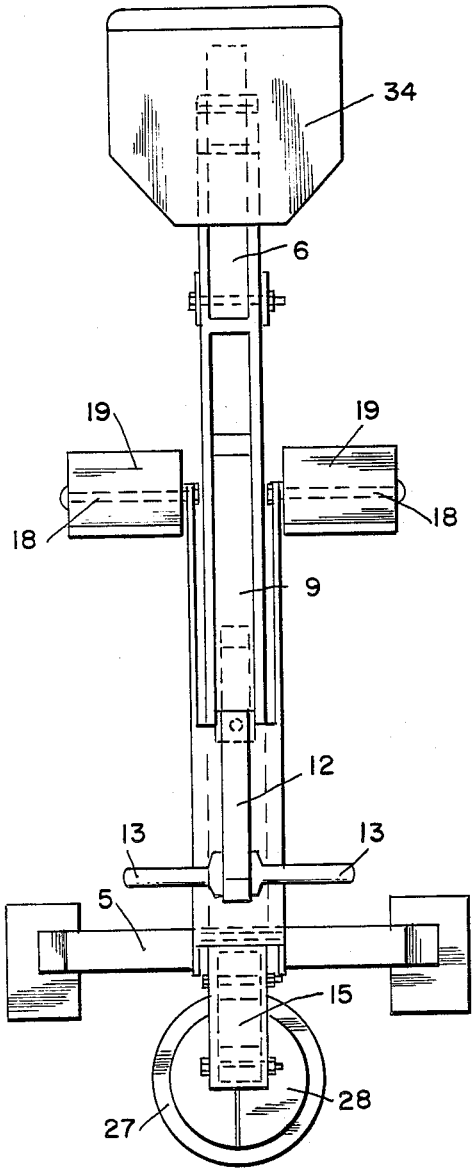
FIG. 5 is a top view of the machine.
Figure 6:
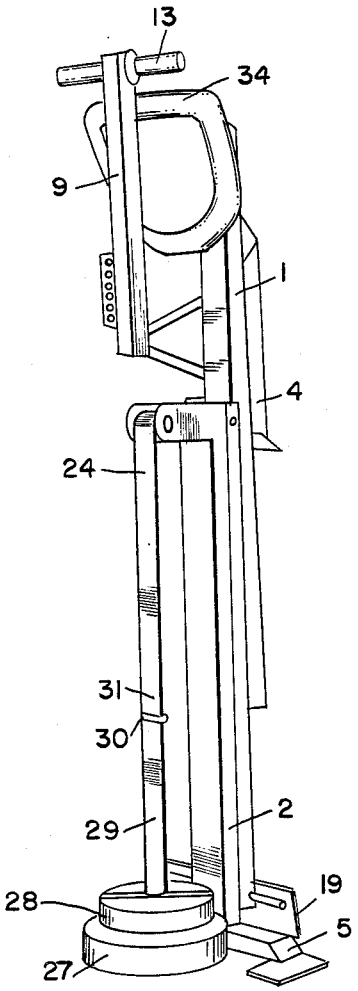
FIG. 6 is an oblique view of the machine folded for storage.

Referring now to the drawings, the main frame members 1 and 2 of the machine are constructed of rectangular steel tubing connected together with two plates 3. These two sturctural members are supported by a rear leg 4 and a front stabalizing leg 5 both of which are steel tubing. The rear leg 4 is connected at an angle to support the machine and person exercising on it and it can be folded along the main tube 1 as shown in FIG. 6. A seat bracket 6 is also welded to frame 1 on which the seat is bolted. The seat can be located in different positions by moving the bolts 7 to different holes. Also welded to frame 1 is a support 8 for the hand lever 9. This support is made of steel strap and has a pivot tube 10 at the upper end. This pivot tube has plastic bushings pressed in from each end making a low friction bearing surface for the bolt connecting the hand lever 9 to the support brackets 8. There is a steel rod 11 welded longitudinally thru the upper end of the support bracket 8 and just below the hand lever pivot 10. This rod acts as a stop for the hand lever 9 in the forward position. The hand lever 9 consists of two pieces of steel tubing that telescope together so as to make its length adjustable. The upper end of tube 12 has a steel pipe 13 extending thru it to form a hand hold for the hand lever. On each end of this steel pipe there is a plastic bushing and hand grip. On the bottom end of the hand lever 9 are welded two metal strips 14 with several holes in them so that the hand lever cable can be connected at several points thus increasing or decreasing the leverage of the hand lever. The vertical frame 2 has welded to it at the top end, a steel plate 15 that has been folded into a U shape making a forward extension at the top of the vertical frame 2. This plate 15 also has a pipe with plastic bushings to make a pivot for the foot lever 17. This foot lever 17 has a steel rod 18 thru the bottom end on which fit the foot pedals 19. These foot pedals likewise have plastic bushings allowing them to pivot easily. A hole is drilled at each end of rod 18 and a split pin inserted which retains the foot pedal and also acts as a pivot stop for the foot pedal 19. An investigation of FIG. 4 shows the inner arrangement of the cable 20 and flat belt 24 which transfers the pull from the hand and foot levers to the weights 27 and 28. The nylon covered steel cable 20 extends from the plastic bushing 21 which connects to the bottom end of the foot lever 17 and extends thru pulley 22 and 25 to the bracket 23 which connects the cable to the flat belt 24. The cable 20 then returns back thru pulley 25, then thru pulley 26 and back to a connecting point on pulley 25. This pulley 26 acts as a fulcrum to the hand lever thereby doubling the leverage of the hand lever so as to more nearly match the stronger push of the leg muscles on the foot lever. The pulley 26 is connected to the hand lever 9 by means of a turnbuckle 27. This turnbuckle allows the hand lever cable to be adjusted to equal the tension on the foot lever cable. Finally comes the weights 27 and 28. These weights are supported by a weight post 29 which is connected to the flat belt 24 by means of a bracket 31 and threaded rod 30. Inspection of the weights show weight 27 to be a solid cylinder while the several weights 28 are cast as half cylinders enabling them to be taken on or off easily. A final embellishment on the machine is a standard machine counter 32 placed at the top of the main frame 2 and connected to the foot lever 17 by means of a spring 33. This allows the operator of the machine to have a continuous count of the number of strokes made on the machine.

To operate the machine the user sits on the seat 34 and places his feet on pedals 19 while leaning forward to grasp the hand grips 13 as shown in FIG. 1. From this starting position the user pushes forward with both feet while at the same time pulling back on the hand lever 9 with both hands until reaching a laid out position as shown in FIG. 2. The cable and flat belt arrangement shown in FIG. 4 transfers the effort from the hand and foot levers to the stack of free weights. The user then restrains the fall of the weights while returning to the starting position all of which completes one stroke of the machine. A continuous action of this type at the rate of about twenty five strokes per minute affords excellent aerobic exercise. The half weights 28 can be removed or added to make a proper weight for each particular person so that they can maintain a steady rhythm for the full exercise period. The use of this machine when properly adjusted, exercises all the major body muscles proportional to their size and strength which in turn provides the most efficient aerobic exercise and consequent greatest cardiovascular improvement. The extremes of movement from the tightly closed position in FIG. 1 to the totally laid out position of FIG. 2 greatly enhances the body strength and flexibility. The total mechanism is very durable and has the added advantage of being collapsible for easy storage as shown in FIG. 6. The machine is also very safe since most of the cables and pulleys are inside the tubular steel members.

A further variation can be arranged by replacing the weights 27 and 28 with springs 37 that would be attached to the bracket 31 and then extended to another bracket 36 attached to the front stabalizing leg 5 as shown in FIG. 7.

FIG. 4 shows three quick pull pins 36 that can be used instead of bolts to enable the machine to be more speedily folded.

While the above description contains many specificaties, these should not be construed as limitations on the scope of the invention, but rather as an exemplification of one preferred embodiment thereof. Accordingly, the scope of the invention should be determined not by the embodiment illustrated. but by the appended claims and their legal equivalents.

Having thus described my invention, what I claim as new and desire to secure by Letters Patent is:

1. An aerobic exercising machine that works all the major body muscles simultaneously comprising:

a. a vertical beam having a cross arm at the foot end and a forward extension at the top end, said forward extension supporting a plurality of free weights;

b. a horizontal beam pivotally connected to said vertical beam by a plate means at approximately one third the height of said vertical beam;

c. a rear leg support pivotally connected to said horizontal beam at the end opposite said vertical beam connection;

d. an adjustable sloping seat bolted to a seat bracket attached to the horizontal beam above the rear leg support;

an adjustable sloping seat connected to said horizontal beam above said rear leg support;

e. a foot lever pivotally attached to the top of said vertical beam, the bottom end of said foot lever having a pair of foot pedals, said foot pedals straddling said horizontal beam;

f. a vertical support connected to said horizontal beam directly forward of said seat, said vertical support having a hand lever pivotally attached thereto, the upper end of said hand lever having a pair of handgrips;

g. a first pulley means operatively connected to said forward extension, a second pulley means operatively connected to said plate means, a third pulley means operatively connected to said hand lever, and a fourth pulley means operatively connected to said horizontal beam proximate said vertical support;

h. cable means having a first end connected to the bottom end of said foot lever and extending through said fourth pulley means, said second pulley means, said third pulley means, back through said second pulley means, through said first pulley means, and having a second end attached to said free weights;

i. a digital counter at the top of said vertical beam and connected to the top end of said foot lever.

2. An aerobic exercising machine according to claim 1 wherein said hand lever is made of a telescoping tube in order to lengthen or shorten the arm reach.

3. An aerobic exercising machine according to claim 2 where said hand lever has several connecting positions for said third pulley means enabling a variation in the swing of the hand lever and also a variation of the effort imposed on the user.

4. An aerobic exercising machine according to claim 1 where said cable means includes a flat belt between said first and second cable means, and said first pulley means includes spools.

5. An aerobic exercising machine according to claim 1 where said third pulley means is operatively connected to said hand lever by a turnbuckle, said turnbuckle enabling the tension on said cable to be equalized with that of said foot lever.

6. An aerobic exercising machine according to claim 1 where part of the free weights include half disks to facilitate easy changing of the total weight.

* * * * *